United States Patent [19]

Pons

[11] Patent Number: 4,896,071

[45] Date of Patent: Jan. 23, 1990

[54] METHOD AND DEVICE FOR SETTING THE STATIC CONVERGENCE AND/OR PURITY OF A COLOR TELEVISION TUBE

[75] Inventor: Claude Pons, Rome, Italy

[73] Assignee: Videocolor, Montrouge, France

[21] Appl. No.: 119,445

[22] Filed: Nov. 12, 1987

[30] Foreign Application Priority Data

Nov. 12, 1986 [FR] France ..... 86 15672

[51] Int. Cl.[4] ..... H01J 29/70

[52] U.S. Cl. ..... 313/428; 313/431; 313/440; 335/210

[58] Field of Search ..... 313/428, 431, 440; 315/368, 370; 335/210, 212

[56] References Cited

U.S. PATENT DOCUMENTS

| | | | |
|---|---|---|---|
| 3,525,831 | 8/1970 | Spisak et al. | 200/48 |
| 3,912,970 | 10/1975 | Chandler et al. | 315/370 |
| 4,001,877 | 1/1977 | Simpson | 358/10 |
| 4,138,628 | 2/1979 | Smith | 315/368 |
| 4,211,960 | 7/1980 | Barten et al. | 315/368 |
| 4,220,897 | 9/1980 | Barten et al. | 315/368 |
| 4,261,017 | 4/1981 | Branton | 335/212 X |
| 4,364,079 | 12/1982 | Pons | 358/10 |
| 4,369,418 | 1/1983 | Archer | 335/210 X |
| 4,396,897 | 8/1983 | Sluijterman et al. | 335/210 X |
| 4,535,313 | 8/1985 | Van der Heijde | 313/431 X |
| 4,604,071 | 8/1986 | Pons | 445/4 |
| 4,636,694 | 1/1987 | DePaolis | 315/368 |
| 4,638,219 | 1/1987 | Pons | 315/368 |
| 4,641,062 | 2/1987 | Pons | 315/368 |

FOREIGN PATENT DOCUMENTS

| | | | |
|---|---|---|---|
| 123611 | 10/1984 | European Pat. Off. . | |
| 135072 | 3/1985 | European Pat. Off. . | |
| 2291604 | 11/1976 | France . | |
| 27781 | 2/1980 | Japan | 315/370 |

*Primary Examiner*—Donald J. Yusko
*Assistant Examiner*—Michael Horabik
*Attorney, Agent, or Firm*—Pollock, VandeSande & Priddy

[57] ABSTRACT

A method is disclosed for the setting of the static convergence and/or purity of a color television tube using permanent magnets. Magnetizable elements are fixed around the color television tube. These elements are evenly distributed around the axis of the tube. To correct the static convergence and/or purity errors, each element is magnetized by means of a corresponding coil, the position and dimensions of which are such that the element is subjected solely to the field within the turns of the coil.

17 Claims, 1 Drawing Sheet

10
11
12
13
14
15
16
18
19
20

$18_4$
$18_2$
$18_6$
14
22
21
25
$24_1$
$18_1$
17
$23_1$
$23_8$
$18_8$ 18
23

METHOD AND DEVICE FOR SETTING THE STATIC CONVERGENCE AND/OR PURITY OF A COLOR TELEVISION TUBE

BACKGROUND OF THE INVENTION

1. Field of the Invention

The invention pertains to a method and a device with a permanent magnet, used to set the static convergence and/or purity of a color television tube.

2. Description of the Prior Art

A color television (or display) tube usually has three electron guns designed to excite luminophors placed against the inner surface of the envelope or front part of the tube. These luminophors are arranged in groups of three dots (triads) or three bands and, in each group, one dot or one band is intended to emit, when excited, a light of a specified color, generally red, green or blue.

In a standard tube, a perforated mask is set before the screen in such a way that each luminophor is excited only by the electron gun designed to excite the corresponding color.

The scanning of the screen by electron beams is obtained through two deflectors, one providing the horizontal deflection and the other the vertical deflection. Each deflector consists of a coil supplied with current. The two coils are generally mounted on one and the same support around the neck and flared part of the television tube.

To obtain a faithful reproduction of the outlines of the images (without colored fringes), all three electron beams must converge to form one and the same virtual light spot on the screen, it being virtual because it is hidden by the mask. This result is obtained by a so-called convergence setting when the tube is being manufactured.

The three electron beams must also have precise positions with respect to the screen, and a gun assigned to one color should reach only those luminophors that produce this color. If not, the colors will not be pure. For this reason, when manufacturing the tube, a so-called purity setting is made.

Settings in which scanning (i.e. the action of the deflectors) is used are called dynamic settings. They consist in the precise positioning of the deflector with respect to the rest of the tube.

Settings in which scanning is not used are called static settings. Purity settings and static convergence settings are of this type. They are done either by moving magnets or by modulating the induction of the poles of a magnetizable ring placed around the neck of the cathode tube The French patent No. 83 06832 which corresponds to U.S. Pat. No. 4,641,062, filed on behalf of the Applicant, describes a method for setting the purity and static convergence of the tube. In this method, a magnetized ring is placed around the neck of the tube and eight poles, evenly distributed around the axis, are created in the said magnetized ring by means of magnetizing coils applied against the external surface of the ring so that a current of a given intensity in a coil engenders a magnetic pole having a clearly defined induction value. The magnetization method is, for example, the one described in the French patent No. 83 06833 which corresponds to U.S. Pat. No. 4,636,694, also filed on behalf of the Applicant, wherein the magnetic material is strongly magnetized and then the magnetization is reduced by reversing it to reach the induction which makes it possible to set the static convergence and/or purity.

It has been observed that in the method in which the end of a coil is applied to the external surface of a magnetizable ring, the setting precision obtained is not satisfactory. It has been discovered that this lack of precision has the following cause: each coil produces, outside its turns, a field with a direction opposite to the one created inside the turns. The useful field is the one produced inside the turns. By contrast, the field with an opposite direction creates, around each pole, a pole with an opposite direction which is the cause of the lack of precision observed. This lack of precision increases with the number of poles.

The invention removes these disadvantages.

SUMMARY OF THE INVENTION

According to the invention, the device for setting static convergence and/or purity comprises separate magnetizable elements distributed evenly around the neck of the tube, each of the said magnetizable elements being magnetized by means of a corresponding coil with a position and dimensions such that the element is subjected solely to the field inside the turns of the coil.

With this method, each magnetizable element is thus not disturbed by the field outside the coil. The setting precision can therefore be increased.

To magnetize each element in order to obtain the purity and/or static convergence setting, the invention uses a device to measure errors of purity and static convergence and, since the relation between each error and the current to be given to each coil is known by means of a prior calibration, a computing means is used so that each coil receives the quantity of energy that it needs to make the correction.

To measure errors of static convergence, the device described in the French patent No. 80 07412 which corresponds to U.S. Pat. No. 4,364,079 can be used, and to measure purity errors the device described in the U.S. Pat. No. 4,001,877 can be used.

The magnetizable elements are, for example, made of "plastoferrite", namely a ferrite (for example barium) buried in a plastic material.

The outline of each magnetizable material is preferably rectangular with sides parallel to the axis of the tube. For the same space occupied, this shape gives more efficient correction than other shapes, such as circular or elliptical ones.

In the preferred embodiment of the invention, the magnetizable elements are fixed to the deflector support. Thus, it is not necessary to plan special supports for these elements. Furthermore, these magnetizable elements can be mounted on the support of the deflector before the said deflector is fitted on the tube proper, so that the static convergence and purity settings do not require any mechanical operation such as the shifting of the magnetizable elements or a bonding operation.

It must also be noted that, with the invention, a smaller amount of magnetizable material is used than with a continuous ring.

BRIEF DESCRIPTION OF THE DRAWINGS

Other features and advantages of the invention will emerge from the following description of some of its embodiments, made with reference to the appended drawings, of which.

DESCRIPTION OF A PREFERRED EMBODIMENT

Figure 1:
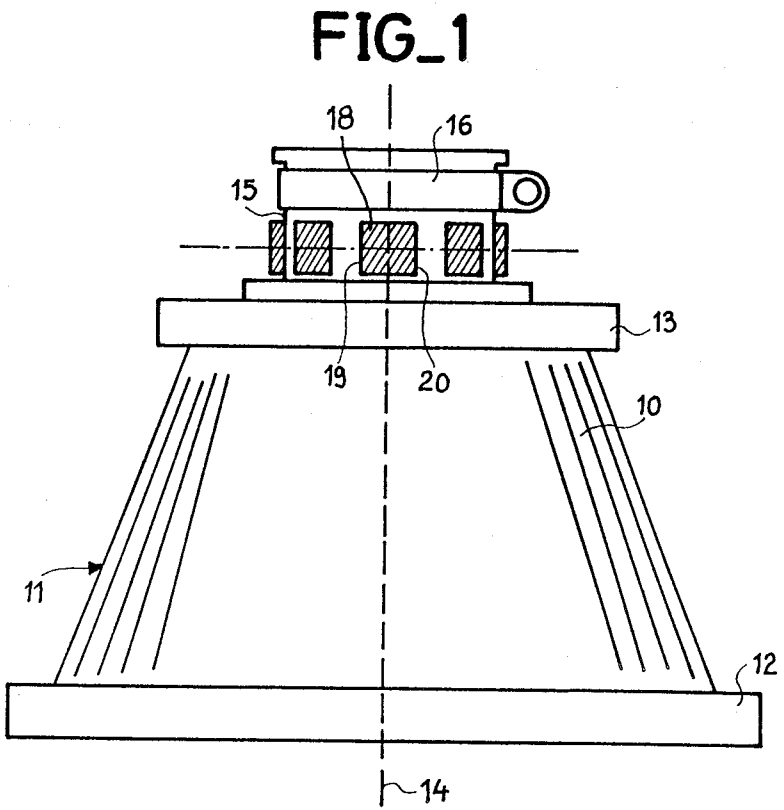
FIG. 1 is a drawing of a deflector of a color television tube with, according to the invention, the magnetizable elements fixed to the support of the deflector.
Figure 2:
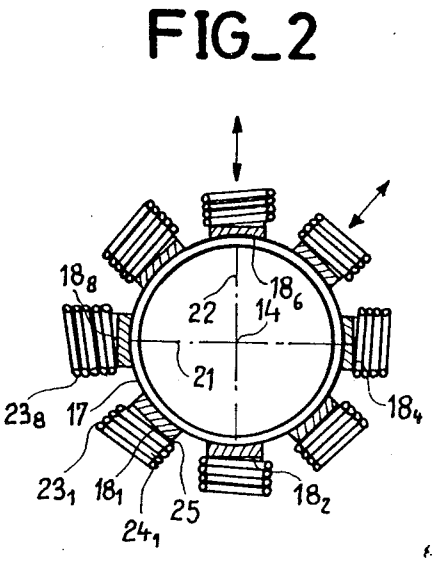
FIG. 2 shows the magnetizable elements of FIG. 1 being magnetized.
Figure 3:
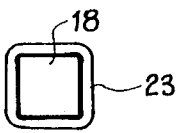
FIG. 3 shows a coil and a magnetizable element.

In the example shown in the FIGS., the coils 10 of the deflector of a color television tube are mounted on a tapering part of a support 11 made of plastic material. The said coils are mounted between two edges, 12 in front and 13 behind, which extend in a plane perpendicular to the axis 14 of the tube (identical with the axis of the support). Behind the edge 13, the support 11 has a cylindrical projection 15, the axis of which is identical with the axis 14 of the tube. The said cylindrical projection 15 is designed to take a collar 16 that clamps the support to the tube.

The magnetizable elements $18_1$–$18_8$ of the invention are fixed, for example by bonding, to the external surface 17 of this cylindrical projection 15. In the example the said magnetizable elements are fixed between the edge 13 and the collar 16.

There are eight of these magnetizable elements $18_1$, $18_2$...$18_8$. They are arranged evenly around the axis 14. All the elements have the same shape and the same size, and are made of the same material, namely a plastoferrite formed of a barium ferrite buried in a matrix of plastic material. Each element 18 is made up of a rectangular slice, preferably square-shaped, with two sides 19 and 20 parallel to the axis 14.

The distribution of the slices is such that the axis 21 joining the centers of the slices $18_4$ and $18_8$ is parallel to the horizontal axis of the screen, the axis 22 joining the centers of the slices $18_2$ and $18_6$ is parallel to the vertical axis of the screen and the axes joining the other diametrically opposite slices, $18_3$ and $18_7$, and $18_1$ and $18_5$ are at angles of 45° with respect to the axes 21 and 22.

For the magnetization of the eight slices $18_1$...$18_8$, a device comprising eight magnetization coils $23_1$...$23_8$ is provided. Each of these eight magnetization coils is wound on a core $24_1$... with a square section, the side of which is slightly longer than the side of the square of the corresponding slice 18. To do the magnetization, the end 25 of the core 24 is applied to the external surface of the slice 18.

Since the section of the coil 23 is greater than the section of the slice 18, the latter is subjected solely to the internal field of the coil. This field has only one direction. In one of the simplest embodiments, the last turn of the coil 23 is practically in the plane of the end 25 of the core 24. In another embodiment, which may give better results, there are turns of the coil beyond the side of the end 25 of the core 24 so that these turns entirely cap the slice 18.

Each element 18 is in a zone with a uniform field. No part of the magnetic material is in the vicinity of the periphery of the coils, which is a zone of high field variation and field reversal. The magnetization is thus at its maximum level and is highly uniform. Furthermore, there is no interaction among the poles.

For the manufacturing of each tube, the coils 23 are moved radially by electrical motors and by means to convert the rotational movement into a translational movement, or by electromagnets, to apply these coils to the slices and then move them away.

These sliding coils are preferably fixed to the platform normally used to support the deflector and position it on the tube, thus favoring the precise positioning of each coil 23 with respect to the corresponding magnetic element 18. Each coil 23 then has a well-determined position (determined by the platform) with respect to the deflector and, hence, with respect to the associated element 18. The platform is, for example, the one described in the French patent No. 83 06834 which corresponds to U.S. Pat. No. 4,689,219 on behalf of the Applicant.

For the purpose of calibration it is easy to determine, for example empirically, the movement of each beam of electrons according to the amplitude of the current of the corresponding magnetization coil. The relation between the current pulses and the resulting movements can be made linear by a simple algebraic transformation.

Thus, the effect of the coils on the electron beams may be expressed by the following matrix relation:

(1) $D=K.B.$

In this formula D is a vector with six components (two for each beam) representing the shifts of the impact points of the electron beams on the screen. B represents the eight values of current applied to the setting coils and K is the matrix of calibration coefficients with six rows and eight columns.

In practice, the inverse relation is used:

(2) $B=C.A.$

In this formula, B is the vector of the eight amplitudes of setting pulses, and A is the vector of the six actions (shifts) needed. The measurement of these shifts results from the determining of the static convergence and purity errors. C is the matrix, with eight rows and six columns, of the setting coefficients calculated, deduced from the matrix K above.

The following method is used to make the static convergence and purity settings:

The tube on which a deflector has been mounted is placed on a setting machine, for example the platform mentioned above. Then, the magnetization coils 23 are applied, by the end sides 25 of their cores 24, against the corresponding slices 18. The convergence and purity errors at the center of the screen are read and a microprocessor, for example, is used to calculate the pulses B to correct the errors observed, according to the above formula (2). This microprocessor is also used to monitor the magnetization sequence which is done by means of two pulses with reverse directions as described in the French patent No. 83 06833.

A single cycle for the measuring of convergence and purity errors and the calculation of magnetization pulses is not usually enough to keep the errors below a pre-determined limit. Usually, three to four cycles are needed for the convergence errors to be 0.1 mm. at the maximum and for the purity errors to be about 10 microns at the maximum. This constraint raises no problems if the magnetization method described in the French patent No. 83 06833 corresponding to U.S. Pat. No. 4,636,694 is used, for with this method, the total setting time is smaller than 10 seconds.

After static setting, the dynamic settings, namely the positioning and fixing of the deflector, are made. After the dynamic settings, the static settings may be re-examined. Two or three static and dynamic setting cycles will be enough to obtain a satisfactory result.

In the embodiment described above, the median lines, perpendicular to the axis 14, of all the slices 18 are in one and the same plane. In one alternative, other magnets are provided with their median lines in another (or in several other) plane or planes perpendicular to the axis 14. These additional magnets can be used, for example, for the horizontal centering of the image or to compensate for an error in the alignment of the guns with respect to the screen.

The elements 18 are preferably mounted automatically on the support of the deflector before the said deflector is mounted on the tube proper.

In one alternative however, the slices 18 are placed directly on the neck of the tube, without using the support of the deflector.

What is claimed is:

1. A method for the setting of static convergence of a color television tube using permanent magnets, wherein magnetizable elements are fixed around the tube, the said elements being evenly distributed around the axis of the tube and wherein, to correct static convergence errors, each element is magnetized by means of a corresponding coil, the position and dimensions of which are such that each element is subjected only to the field inside the turns of the corresponding coil.

2. A method according to claim 1 wherein each magnetizable element has the general shape of a rectangular or square slice with sides parallel to the axis of the tube.

3. A method according to claim 1 wherein each element has a rectangular or square slice shape and wherein the slices have identical shapes and dimensions.

4. A method according to the claim 2 wherein the median lines perpendicular to the axis of the tube, of the slices, are in one and the same plane.

5. A method according to claim 1 wherein the magnetizable elements are fixed to a support of a deflector of the color television tube.

6. A method according to the claim 5 wherein the deflector support has a tapering part limited by a front edge and a rear edge, as well as a rear cylindrical part, wherein the magnetizable elements are fixed to the said cylindrical part.

7. A method according to the claim 5 wherein the magnetizable elements are fixed to the support of the deflector before the support is mounted on the tube.

8. A method according to claim 1 wherein each magnetization coil of a magnetizable element is wound on a core and wherein the end turn of this coil is in the same plane as the end side of the core.

9. A method according to claim 1 wherein an end of a magnetization coil caps the corresponding magnetizable element during the magnetization process.

10. A method according to claim 1 wherein magnetization coils of the magnetizable elements are mounted on a platform which supports a deflector of the tube and also positions the deflector.

11. A color television tube comprising a deflector with a support mounted around the tube proper, as well as static convergence setting means of the type with a permanent magnet, wherein the static convergence setting means comprise separate permanent magnets arranged evenly around the axis of the tube and fixed to the support of the deflector.

12. A tube according to claim 11 wherein each magnet takes the form of a slice.

13. A tube according to claim 12 wherein each slice has a rectangular or square section which sides parallel to the axis of the tube.

14. A color television tube comprising static convergence setting means of the type with a permanent magnet, wherein the static convergence setting means comprise separate permanent magnets arranged evenly around the axis of the tube, wherein each magnet has the form of a slice of rectangular or square section with sides parallel to the axis of the tube, the plane of greater area of each slice being tangential with respect to the cylindric surface of the neck of the tube.

15. A color television tube comprising static convergence setting means of the type with a permanent magnet wherein said static convergence setting means comprise separate permanent magnets arranged evenly around the axis of the tube, each permanent magnet comprising solely a field with a single direction.

16. A tube according to claim 15 wherein each permanent magnet has the form of a slice, the plane of greater area of which is tangential with respect to the cylindric surface of the neck of the tube.

17. A tube according to claim 13 wherein the plane of each slice is tangential with respect to the cylindric surface of the neck of the tube.

* * * * *